US010227887B2

(12) United States Patent
Lemke et al.

(10) Patent No.: US 10,227,887 B2
(45) Date of Patent: Mar. 12, 2019

(54) FLUID MACHINE WITH VARIABLE VANES

(71) Applicant: HANWHA POWER SYSTEMS CO., LTD., Changwon-si (KR)

(72) Inventors: Paul Lemke, Cypress, TX (US); Karl Wygant, Pearland, TX (US)

(73) Assignee: HANWHA POWER SYSTEMS CO., LTD., Changwon-si (KR)

( * ) Notice: Subject to any disclaimer, the term of this patent is extended or adjusted under 35 U.S.C. 154(b) by 570 days.

(21) Appl. No.: 14/876,961

(22) Filed: Oct. 7, 2015

(65) Prior Publication Data

US 2017/0101885 A1 Apr. 13, 2017

(51) Int. Cl.
*F01D 17/16* (2006.01)

(52) U.S. Cl.
CPC ..... *F01D 17/16* (2013.01)

(58) Field of Classification Search
CPC ..... F01D 17/16
USPC ..... 415/148, 164, 150
See application file for complete search history.

(56) References Cited

U.S. PATENT DOCUMENTS 4,804,316 A * 2/1989 Fleury ..... F01D 17/165 415/134
5,146,752 A * 9/1992 Bruestle ..... F01D 17/105 415/164
6,269,642 B1 8/2001 Arnold et al.
6,409,483 B2 * 6/2002 Jinnai ..... F01D 17/165 415/150
6,527,508 B2 * 3/2003 Groskreutz ..... F01D 17/165 415/150
7,114,919 B2 * 10/2006 Scholz ..... F01D 17/165 415/164
7,886,536 B2 * 2/2011 Hemer ..... F01D 17/165 415/159
8,021,106 B2 * 9/2011 Battig ..... F01D 17/165 415/160
9,429,033 B2 * 8/2016 Martin ..... F01D 17/16
(Continued)

FOREIGN PATENT DOCUMENTS

JP 200127124 A 1/2001
KR 10-2014-0138716 A 12/2014
WO WO 2014/105378 * 7/2014

OTHER PUBLICATIONS

Communication dated Jun. 20, 2017, issued by the Korean Intellectual Property Office in corresponding Korean Application No. 10-2016-0034713.

*Primary Examiner* — Aaron R Eastman
(74) *Attorney, Agent, or Firm* — Sughrue Mion, PLLC

(57) ABSTRACT

A fluid machine with variable vanes includes: a case, a plurality of vanes arranged along a circumferential direction of the case; a transmission ring rotatably provided in the case and configured to rotate with respect to the case; a transmission member provided on the transmission ring; and a driving assembly detachably attached to the case and including: a driving shaft; and a connection member connected to the transmission member through a through hole of the case provided at a position corresponding to the transmission member and configured to rotate together with the driving shaft, wherein the connection member is disengageably engaged with the transmission member such that the driving assembly is disconnected from the case through the through hole.

17 Claims, 9 Drawing Sheets

(56) References Cited

U.S. PATENT DOCUMENTS

| | | | | |
|---|---|---|---|---|
| 2011/0110767 | A1* | 5/2011 | Castan | F01D 17/165<br>415/159 |
| 2012/0121403 | A1* | 5/2012 | Clemons | F01D 17/162<br>415/208.1 |
| 2013/0223978 | A1* | 8/2013 | Kitzmiller | F03B 3/183<br>415/1 |
| 2014/0161595 | A1* | 6/2014 | Tashiro | F02B 37/24<br>415/146 |

* cited by examiner

FLUID MACHINE WITH VARIABLE VANES

BACKGROUND

1. Field

Apparatuses consistent with exemplary embodiments relate to fluid machines with variable vanes, and more particularly, to fluid machines that may be conveniently maintained because a driving assembly of the fluid machine may be easily disconnected/connected from/to a case of the fluid machine.

2. Description of the Related Art

In a fluid machine such as a compressor or an expander, a fluid flow control device such as an inlet guide vane (IGV) or a variable geometry diffuser (VGD) is used to control a flow rate to increase efficiency or to control an operation region (i.e., an operation envelop) to implement stability control.

In a device such as an IGV or a VGD, vanes are disposed at a fluid flow passage and rotated to adjust the size of the fluid flow passage. In the related art, in order to rotate the vanes, a motor and an actuator linkage for transmitting the rotation force of the motor are also integrated and assembled in the fluid machine.

U.S. Pat. No. 6,527,508 discloses a technology for rotating vanes by using crank arms in variable geometry turbochargers. By this operation mechanism, the vanes may be rotated by a predetermined angle. A motor and an actuator linkage have to be installed in a casing of the fluid machine in order to drive the crank arms. Also, a seal ring has to be disposed between the casing and the actuator linkage in order to prevent the leakage of a fluid from the fluid machine. Thus, in such fluid machine described above, it is difficult to repair the seal ring and the actuator linkage or replace aged components. Because all electric lines and mechanical components such as fluid outlet pipes and fluid inlet pipes connected to the fluid machine have to be first disconnected in order to disconnect the motor and the actuator linkage from the casing of the fluid machine, the maintenance of the fluid machine is difficult, time consuming, and costly.

Similarly, Japanese Patent Laid-Open Publication No. 2001-027124 discloses a fluid machine that rotates a variable nozzle by using an air cylinder. However, in this fluid machine, the air cylinder and a link assembly for transmitting the driving force of the air cylinder to a ring rotating a variable nozzle are connected to a casing of the fluid machine and therefore, the components are very difficult to disconnect. Also, because electric lines and pipes connected to the fluid machine have to be first disconnected in order to perform maintenance on the air cylinder and the link assembly, the maintenance of the fluid machine is also difficult and time consuming.

U.S. Patent Application Publication No. 2012-0121403 discloses a structure in which a rotary actuator is connected to a spacer ring connected to a casing of a compressor and a driving force of the rotary actuator is transmitted to vanes through a driving shaft fixed to a spacer ring thereby driving an IGV of a centrifugal compressor. In this fluid machine, the rotary actuator is fixed to the spacer ring by an attachment bracket and a pneumatic cylinder is disposed outside the driving shaft. Thus, because the electric lines and pipes connected to the fluid machine have to be first disconnected and then the spacer ring, the attachment bracket, the rotary actuator, and the driving shaft have to be disconnected in order to perform maintenance on components such as seal rings and the rotary actuator, the maintenance of the fluid machine is also difficult, time consuming, and costly.

In the fluid machine of U.S. Patent Application Publication No. 2012-0121403, some vanes are directly connected to a driving shaft of a rotary actuator, and other vanes are indirectly driven by a link and a driving shaft rotated by a main crank arm. According to such a structure of the fluid machine, because a high driving force is necessary to drive a driving ring, vanes, and links connected to the respective vanes, the volume of the rotary actuator increases. Also, because the space required for installing the driving ring, the vanes, and the links connected to the respective vanes increases, the size of the fluid machine increases and the structure thereof becomes more complicated.

SUMMARY

One or more exemplary embodiments include fluid machines with variable vanes, which may be conveniently maintained because disassembly/assembly thereof may be easily performed.

One or more exemplary embodiments include fluid machines that are minimized in size and are simplified in the structure of a driving assembly for driving variable vanes.

One or more exemplary embodiments include fluid machines that are configured such that a driving assembly for driving variable vanes may be easily disconnected/connected from/to a case.

Additional aspects will be set forth in part in the description which follows and, in part, will be apparent from the description, or may be learned by practice of the presented exemplary embodiments.

According to an aspect of an exemplary embodiment, there is provided a fluid machine with variable vanes including: a case including a passage through which a fluid passes; a plurality of vanes disposed along a circumferential direction of the passage of the case and being rotatable on the case; a transmission ring disposed rotatably on the case and connected to the vanes to rotate with respect to the case to rotate the vanes; a transmission member disposed on the transmission ring to transmit an external rotation force to the transmission ring; and a driving assembly connected to the case and including a driving shaft disposed outside the case to rotate on a direction crossing a rotation center of the transmission ring and a connection member disposed at an end of the driving shaft to rotate together with the driving shaft and connected to the transmission member at a position deviating outward from a center of the driving shaft through a through hole of the case formed at a position corresponding to the transmission member, wherein the connection member is disconnected from the transmission member to be disconnected outside from the case through the through hole to disconnect the driving assembly from the case.

The driving assembly may further include a driving unit configured to rotate the driving shaft.

The driving assembly may further include a shaft support unit configured to rotatably support the driving shaft and a seal ring disposed between the shaft support unit and the driving shaft.

The through hole of the case may have a circular cross-section, an attachment member having a circular cross-section corresponding to the through hole may be connected to the end of the driving shaft, and the connection member may be disposed at an end of the attachment member.

The connection member may be a pin having a circular cross-section, and the transmission member may include a support hole extended to movably support the pin.

A portion of the support hole of the transmission member may be opened to outside.

The support hole may extend in a direction that is parallel to the rotation center of the transmission ring while crossing a rotation center of the driving shaft.

The driving assembly may further include an end roller connected rotatably to an end of the pin and contacting the support hole.

The fluid machine may further include a fastening member configured to fasten the transmission member and the transmission ring.

The transmission member may be an integral part of the transmission ring.

The transmission member may be a pin protruding toward the connection member and having a circular cross-section, and the connection member may be a support hole extended at an end of the driving shaft to movably support the pin.

The support hole may extend in a direction crossing a radial direction with respect to a rotation center of the driving shaft.

The fluid machine may further include a roller disposed along a circumferential direction of the transmission ring and being rotatable on the transmission ring to support the transmission ring rotatably on the case.

According to an aspect of an exemplary embodiment, there is provided a fluid machine with variable vanes, the fluid machine including: a case including a passage through which a fluid passes; a plurality of vanes arranged along a circumferential direction of the passage of the case and configured to rotate to control an amount of the fluid passing through the passage; a transmission ring rotatably provided in the case and configured to rotate with respect to the case, the plurality of vanes being attached to the transmission ring to rotate with the transmission ring; a transmission member provided on the transmission ring and configured to transmit an external rotation force to the transmission ring; and a driving assembly detachably attached to the case and including: a driving shaft provided at an exterior of the case to rotate with respect to a first axis extending in a direction crossing a rotation axis of the transmission ring; and a connection member provided at a first end of the driving shaft, connected to the transmission member through a through hole of the case provided at a position corresponding to the transmission member and configured to rotate together with the driving shaft, wherein the connection member is disengageably engaged with the transmission member such that the driving assembly is disconnected from the case through the through hole.

The driving assembly may further include a driving unit configured to rotate the driving shaft.

The driving assembly may further include: a shaft support unit configured to rotatably support the driving shaft; and a seal ring provided between the shaft support unit and the driving shaft.

The through hole of the case has a circular cross-section, and wherein the connection member includes: an attachment member having a circular cross-section corresponding to the through hole connected to the first end of the driving shaft and a pin disposed at an end of the attachment member.

The pin may have a circular cross-section, and the transmission member may include a support hole configured to movably support the pin.

A portion of the support hole of the transmission member may be opened.

The support hole may include a slot extends in a direction that is parallel to the rotation axis of the transmission ring and crossing a rotation axis of the driving shaft.

The driving assembly may further include an end roller rotatably connected to an outer surface of the pin and configured to contact the support hole.

The fluid machine may further include a fastening member configured to fasten the transmission member and the transmission ring.

The transmission member may be integrally formed with the transmission ring.

The transmission member may include a pin protruding toward the connection member and having a circular cross-section, and wherein the connection member may include a support hole formed at the first end of the driving shaft to movably support the pin.

The support hole may extend in a direction crossing an axis extending in a radial direction with respect to a rotation center of the driving shaft.

13. The fluid machine may further include a roller disposed along a circumferential direction of the transmission ring and being rotatable on the transmission ring to rotatably support the transmission ring on the case.

The connection member may be configured to engage or disengage with the transmission member in a direction parallel with the direction of a rotation axis of the driving shaft through the through hole.

The connection member may further include a pin disposed at the first end the driving shaft, and wherein the pin may be offset in a radial direction from a rotation center of the driving shaft and is configured to engage with the transmission member.

BRIEF DESCRIPTION OF THE DRAWINGS

The above and/or other aspects of the disclosure will become apparent and more readily appreciated from the following description of exemplary embodiments, taken in conjunction with the accompanying drawings in which.

DETAILED DESCRIPTION

Figure 1:
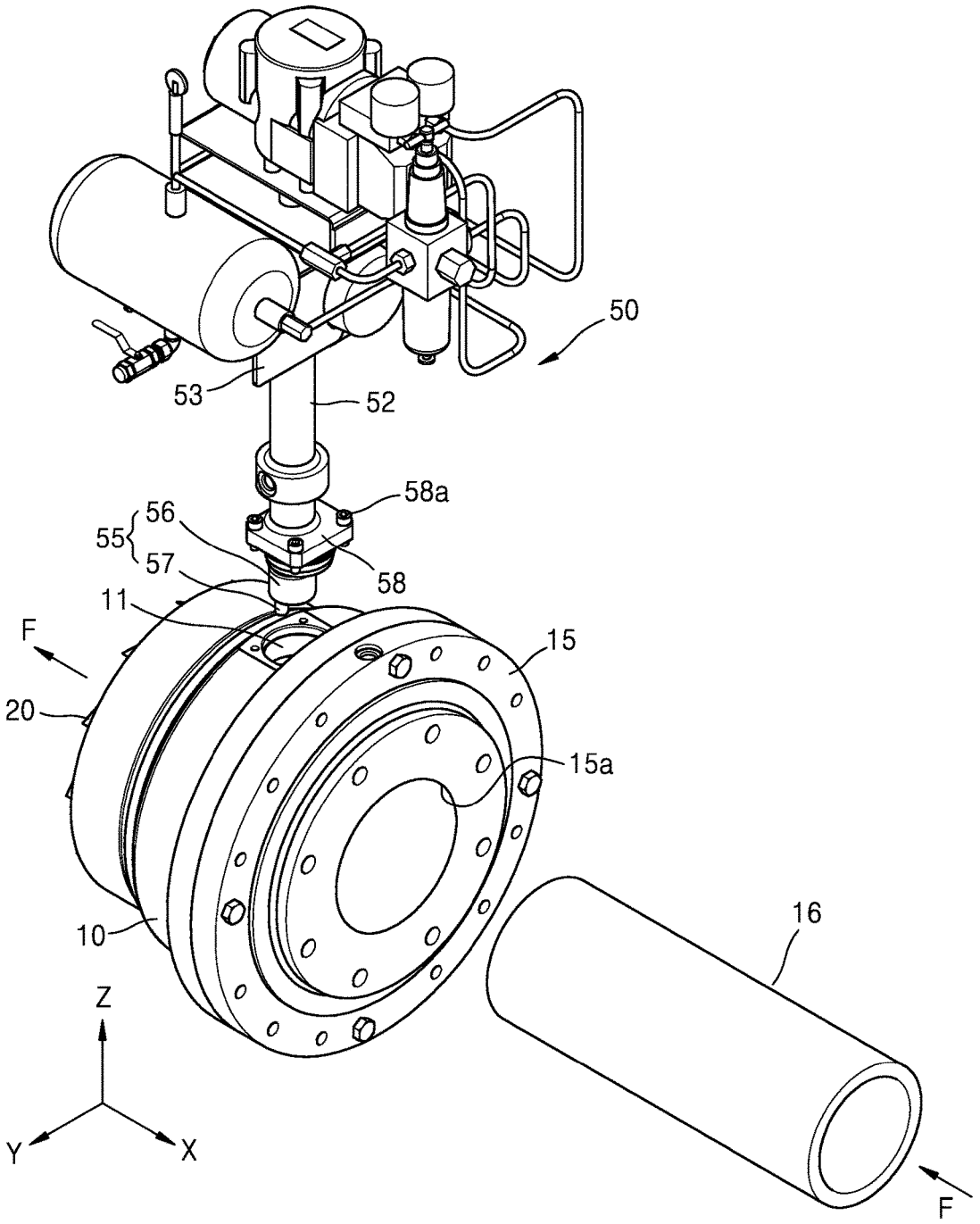
FIG. 1 is a perspective view schematically illustrating the connection relationship between components of a fluid machine with variable vanes according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items.

Hereinafter, the configurations and operations of fluid machines with variable vanes according to exemplary embodiments will be described in detail with reference to the accompanying drawings.

Figure 2:
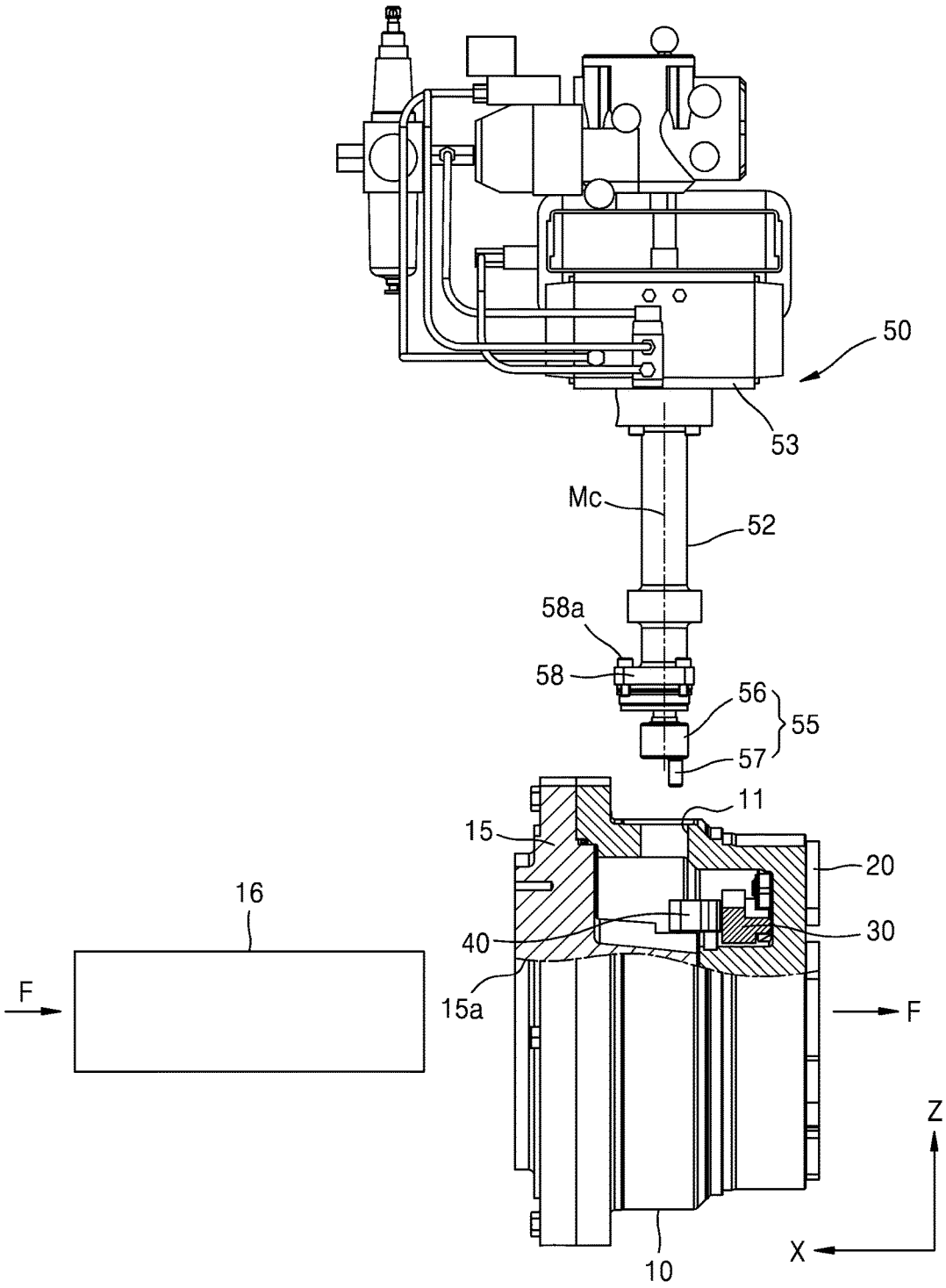
FIG. 2 is a front view illustrating a partial section of the components of the fluid machine of FIG. 1.
Figure 3:
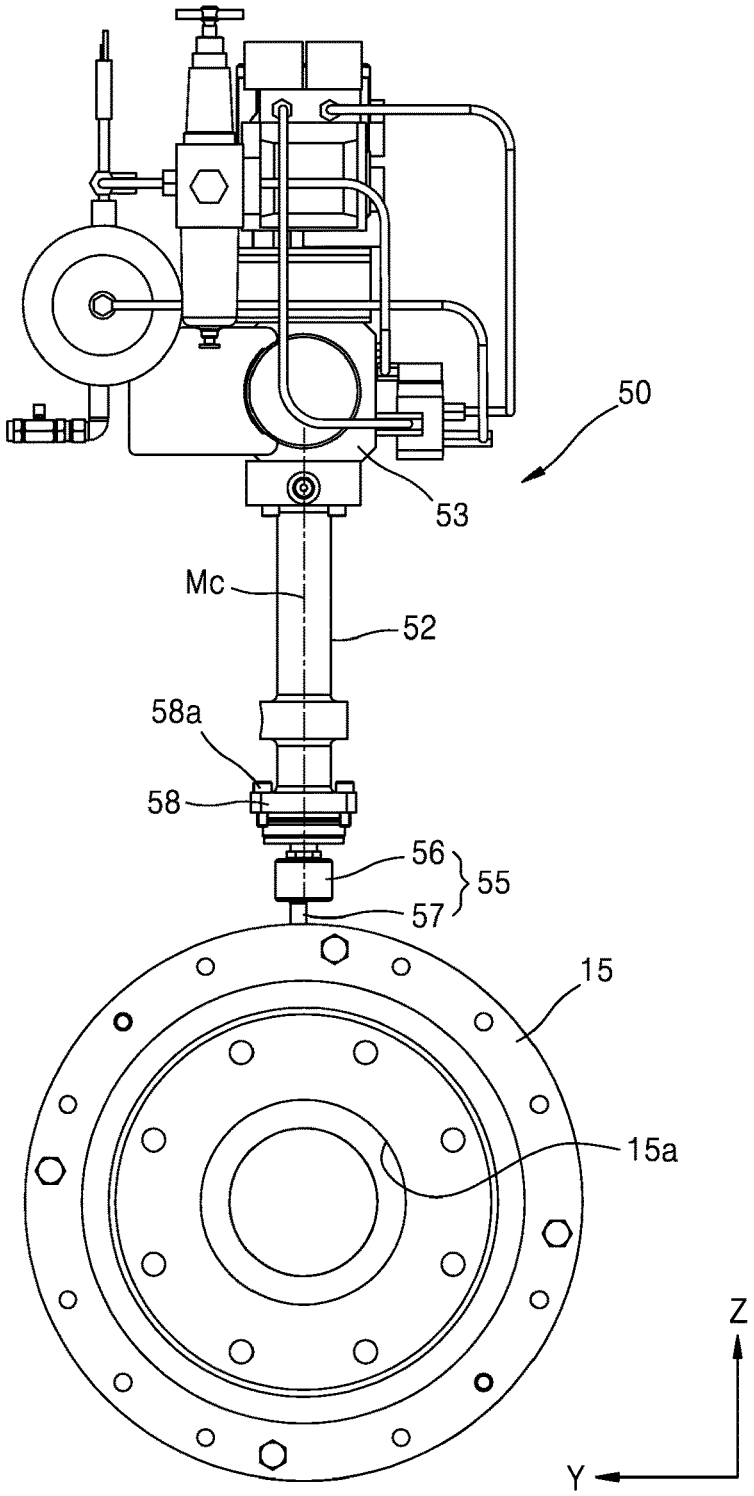
FIG. 3 is a side view of the fluid machine of FIG. 1.
Figure 4:
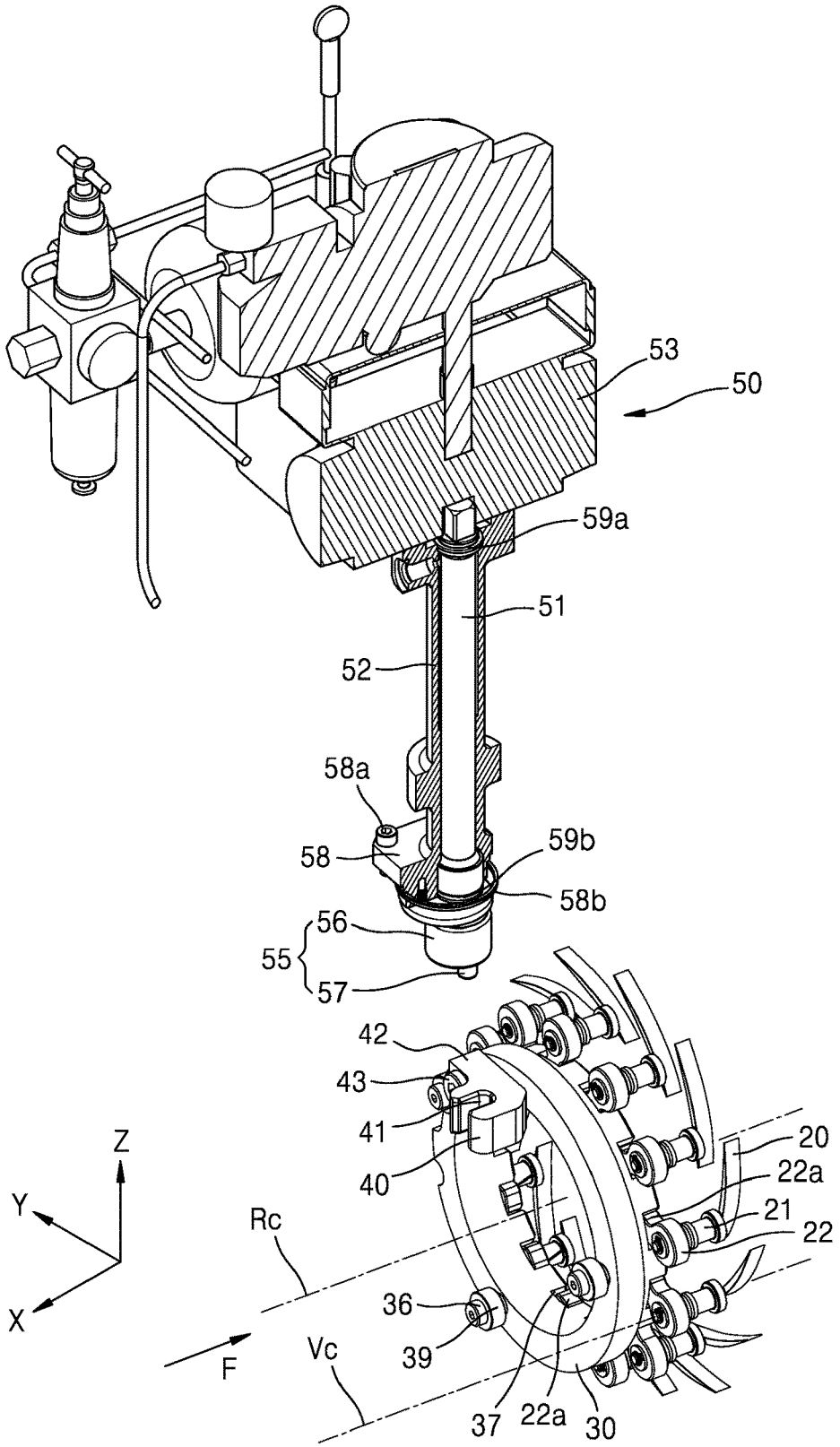
FIG. 4 is a perspective view illustrating the connection relationship between some components of the fluid machine of FIG. 1.

FIG. 1 is a perspective view schematically illustrating the connection relationship between components of a fluid machine with variable vanes according to an exemplary embodiment. FIG. 2 is a front view illustrating a partial section of the components of the fluid machine of FIG. 1. FIG. 3 is a side view of the fluid machine of FIG. 1. FIG. 4 is a perspective view illustrating the connection relationship between some components of the fluid machine of FIG. 1.

The fluid machine with variable vanes according to an exemplary embodiment illustrated in FIGS. 1 to 3 may operate, for example, on a device such as an inlet guide vane or a variable-shaped diffuser of a compressor installed in a liquefied natural gas (LNG) ship.

The fluid machine includes: a case 10 including a passage P through which a fluid F passes; a plurality of vanes 20 disposed at a inner portion of the case 10 and which may be rotated to adjust a size of the passage P of the case 10; a transmission ring 30 disposed inside the case 10 and rotated in the case 10 to rotate the plurality of vanes 20; a transmission member 40 connected to the transmission ring 30 to transmit an external rotation force to the transmission ring 30; and a driving assembly 50 disconnectably connected to the case 10 to transmit the external rotation force to the transmission member 40 to rotate the transmission ring 30.

The case 10 is formed in a hollow cylindrical shape to have the passage P through which the fluid F passes (See FIGS. 2 and 4). The transmission ring 30 is rotatably disposed inside the case 10, and the vanes 20 are rotatably disposed along the circumferential direction of the case 10 or the transmission ring 30. Referring to FIG. 4, the transmission ring 30 may rotate around a transmission ring rotation center Rc.

The plurality of vanes 20 may be arranged along the circumferential direction of a through hole passage on one side of the case 10, and each of the vanes 20 may rotate with respect to a vane rotation center Vc. The transmission ring rotation center Rc and the vane rotation center Vc for each vane 20 are formed to be substantially parallel to each other.

A cover 15 is connected to the other side of the case 10. The cover 15 includes an inflow pipe attachment unit 15*a* connected with an inflow pipe 16 transmitting a fluid F to the case 10.

The transmission ring 30 is formed in a ring shape, and includes a plurality of connection grooves 37 that are formed along the circumferential direction of the transmission ring 30 to correspond to the respective vanes 20. The transmission ring 30 also includes a plurality of rollers 39 that are disposed along the circumferential direction of the transmission ring 30 to rotatably support the transmission ring 30 provided on the case 10. Each roller 39 is rotatably connected to a roller shaft 36 protruding from one surface of the transmission ring 30. When a rotation force is transmitted to the transmission ring 30 to rotate the transmission ring 30, because each roller 39 rotates with respect to the roller shaft 36 while contacting an inner surface of the case 10, the transmission ring 30 may smoothly rotate along the inner surface of the case 10.

Each vane 20 of the plurality of vanes is connected to a vane shaft 21, and the vane shaft 21 is connected to a vane roller 22. Because the vane roller 22 is rotatably provided inside the case 10 to rotate within a predetermined angle range, the vane roller 22, the vane shaft 21, and the vane 20 may rotate together. The vane roller 22 includes an arm 22*a* protruding from the vane roller 22 toward the transmission ring 30. The arm 22*a* of the vane roller 22 is inserted into the connection groove 37 of the transmission ring 30. Therefore, when the transmission ring 30 rotates, the rotation force of the transmission ring 30 is transmitted to the arm 22*a* inserted into the connection groove 37, and the vane roller 22, the vane shaft 21, and the vane 20 may also rotate along the inner surface of the case 10.

The transmission member 40 is connected to the transmission ring 30 to transmit an external rotation force to the transmission ring 30. The transmission member 40 has a cross-sectional shape similar to an "F" shape. The transmission member 40 includes an attachment unit 42 that is fastened to the transmission ring 30 by a fastening member 43, and a support hole 41. In the exemplary embodiment, the fastening member 43 is illustrated as being a bolt. However, the exemplary embodiment is not limited thereto. For example, a different type of mechanical member such as a rivet or a nail may also be used as the fastening member 43.

A portion of the support hole 41 formed in the transmission member 40 is formed between the two parallel portions in the "F" shape. However, the exemplary embodiment is not limited thereto. For example, the support hole 41 of the transmission member 40 may be formed in the shape of a closed hole, so that the transmission member 40 may be formed to have a sectional shape similar to a "P" shape.

The driving assembly 50 is detachably attached to the case 10, and includes a driving shaft 51 and a connection member 55 that is connected to the driving shaft 51 at one end and the transmission member 40 at the other end and rotates together with the driving shaft 51 to transmit a rotation force to the transmission member 40. The driving assembly 50 detachably attached to the case 10 may be easily disconnected by a simple operation of disconnecting the connection between the transmission member 40 and the connection member 55 of the driving assembly 50 to separate the driving assembly 50 from the case 10.

The driving shaft 51 is disposed outside the case 10 and rotates on a direction crossing the transmission ring rotation center Rc that is the rotation center of the transmission ring 30. The driving assembly 50 also includes a driving unit 53 that generates a driving force to rotate the driving shaft 51. The driving unit 53 may include, for example, an electric motor that rotates by an electric signal, or an actuator that generates a driving force by the force of a fluid.

The driving assembly 50 includes a shaft support unit 52 that rotatably supports the driving shaft 51, and seal rings 59*a* and 59*b* that are disposed between the shaft support unit 52 and the driving shaft 51. The seal rings 59*a* and 59*b* are respectively disposed at one end and the other end of the driving shaft 51, and maintains a seal state while the driving shaft 51 is rotating on the shaft support unit 52.

A flange 58 extending radially outward from the shaft support unit 52 is disposed at the end of the shaft support unit 52 in a longitudinal direction of the shaft support unit 52. The flange 58 is connected to the outside of the case 10 by a fastening unit 58*a*. A static seal ring 58*b* is disposed between the end of the flange 58 and the case 10 to maintain a sealed state between the case 10 and the flange 58.

The connection member 55 is disposed at the end of the driving shaft 51 to rotate together with the driving shaft 51. A through hole 11 having a circular cross-section is formed in a wall of the case 10 at a position corresponding to the support hole 41 of the transmission member 40. The connection member 55 is connected to the transmission member 40 through the through hole 11. The connection member 55 has a circular cross-section corresponding to the through hole 11, and includes an attachment member 56 disposed at the end of the driving shaft 51 and a pin 57 disposed at the end of the attachment member 56.

In the exemplary embodiment, the connection member 55 is illustrated as including the attachment member 56 and the pin 57. However, the exemplary embodiment is not limited thereto. For example, the attachment member 56 may be omitted from the connection member 55 and the pin 57 may be directly provided at the end of the driving shaft 51 to engage with the transmission member 40.

Referring to FIGS. 2 and 3, the shaft support unit 52 including the driving shaft 51 may rotate with respect to a driving shaft rotation center Mc. The connection member 55 may rotate with respect to a driving shaft rotation center Mc. However, the pin 57 of the connection member 55 is connected to the transmission member 40 at a position deviating radially outward from the driving shaft rotation center Mc of the driving shaft 51.

Figure 5:
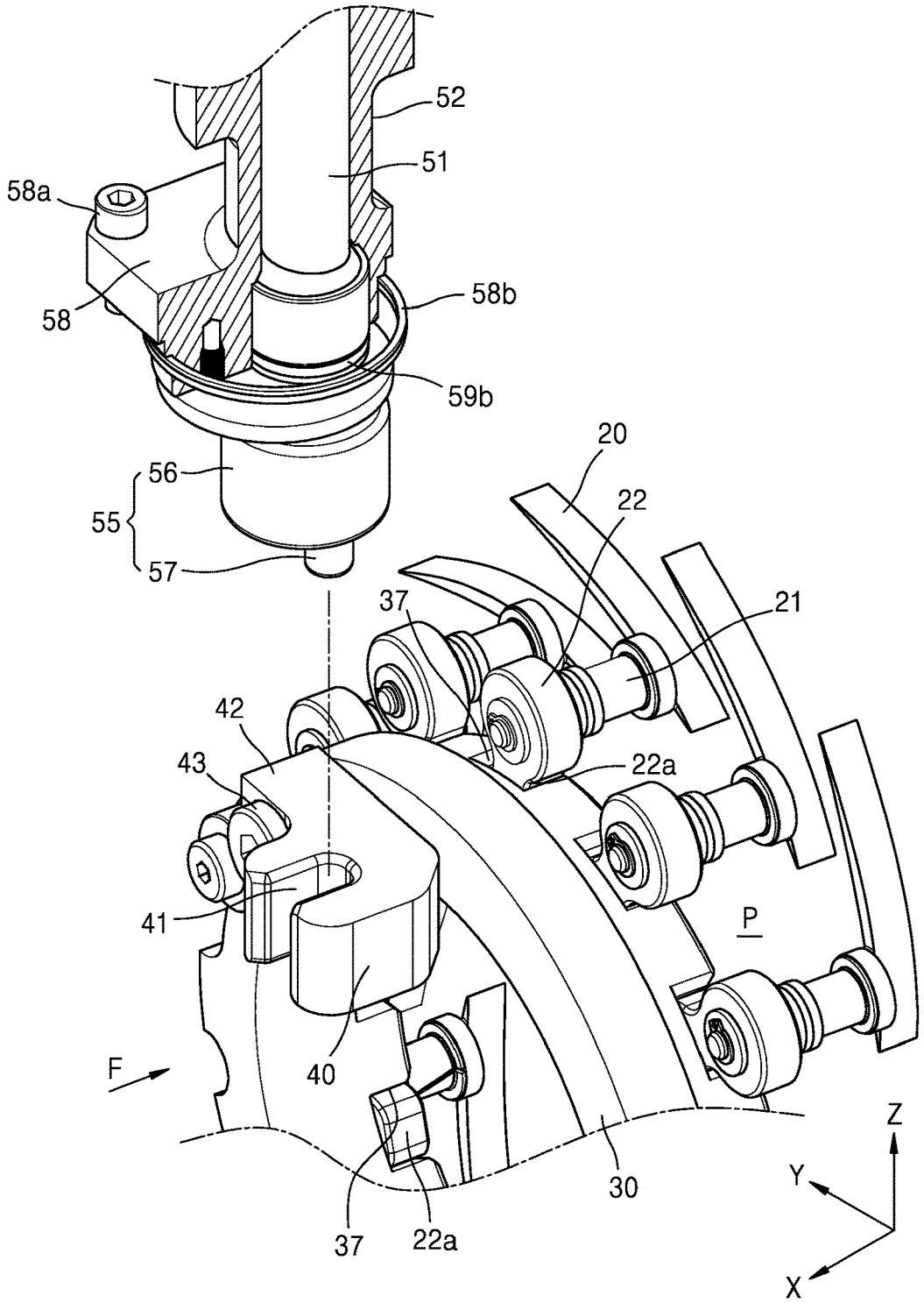
FIG. 5 is an enlarged perspective view of some components illustrated in FIG. 4.
Figure 6:
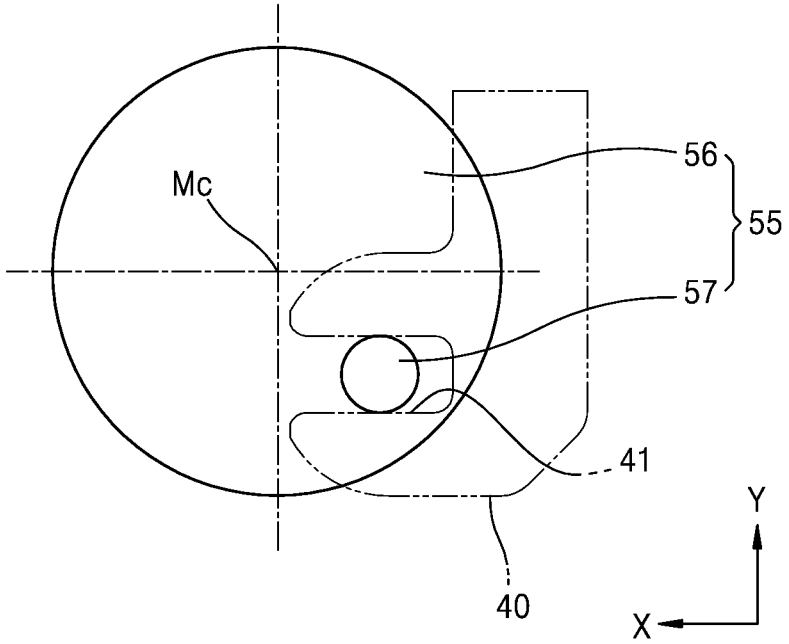
FIG. 6 is a cross-sectional view schematically illustrating the connection relationship between a connection member and a transmission member in the fluid machine of FIG. 1.

FIG. 5 is an enlarged perspective view illustrating a connection between the connection member 55 and the transmission member 40 of FIG. 4. FIG. 6 is a cross-sectional view schematically illustrating the connection relationship between the connection member 55 and the transmission member 40 in the fluid machine of FIG. 1.

The pin 57 of the connection member 55 is disposed at a position that is offset by a predetermined distance from the driving shaft rotation center Mc of the driving shaft 51. Also, the pin 57 has a circular cross-section and is connected to the support hole 41 of the transmission member 40. That is, the pin 57 of the connection member 55 is disengageably engaged with the support hole 41 of the transmission member 40 such that the driving assembly 50 may be easily disconnected from the case through the through hole.

When the driving shaft 51 is rotated to rotate the attachment member 56 of the connection member 55, the pin 57 rotates around the driving shaft rotation center Mc. While the X-direction position and Y-direction position of the pin 57 are changed by the rotation of the pin 57, the transmission member 40 connected with the pin 57 through the support hole 41 may not move in the X-axis direction and only the Y-direction position thereof may change. That is, because the rotation force of the driving shaft 51 is transmitted to the transmission member 40 through the pin 57 and the pin 57 presses the transmission member 40 in the Y-axis direction, the force of the driving shaft 51 is transmitted to the transmission ring 30 through the transmission member 40 to rotate the transmission ring 30 on the case 10 with respect to the transmission ring rotation center Rc.

Because the seal rings 59*a* and 59*b* contact the rotating driving shaft 51, the seal rings 59*a* and 59*b* may be worn during the use of the fluid machine. Thus, components such as the seal rings 59*a* and 59*b* have to be replaced periodically.

In the related art, because such components constituting a mechanism for driving variable vanes are united with a fluid machine, a complex operation of disconnecting all of electric lines and pipes connected to the fluid machine and disassembling/assembling the entire fluid machine may have to be performed in order to replace the components such as the seal rings 59*a* and 59*b*.

In the fluid machine according to the exemplary embodiment, the seal rings 59*a* and 59*b* may be easily maintained. The driving assembly 50 may be disconnected from the case 10 by disconnecting the connection member 55 from the transmission member 40 and disconnecting the connection member 55 away from the case 10 through the through hole 11 of the case 10. The operation of disconnecting the driving assembly 50 from the case 10 may be manually performed by an operator by using an apparatus such as a crane, or may be automatically performed.

After the driving assembly 50 is disconnected from the case 10, only the driving assembly 50 may be disassembled to replace or repair the components such as the seal rings 59*a* and 59*b*. Because the driving assembly 50 may be easily disconnected from the case 10, the driving assembly 50 of the fluid machine may be easily maintained even without performing a complex operation of disconnecting the case or disconnecting an electric line or a fluid inflow pipe connected to the case 10.

Figure 7:
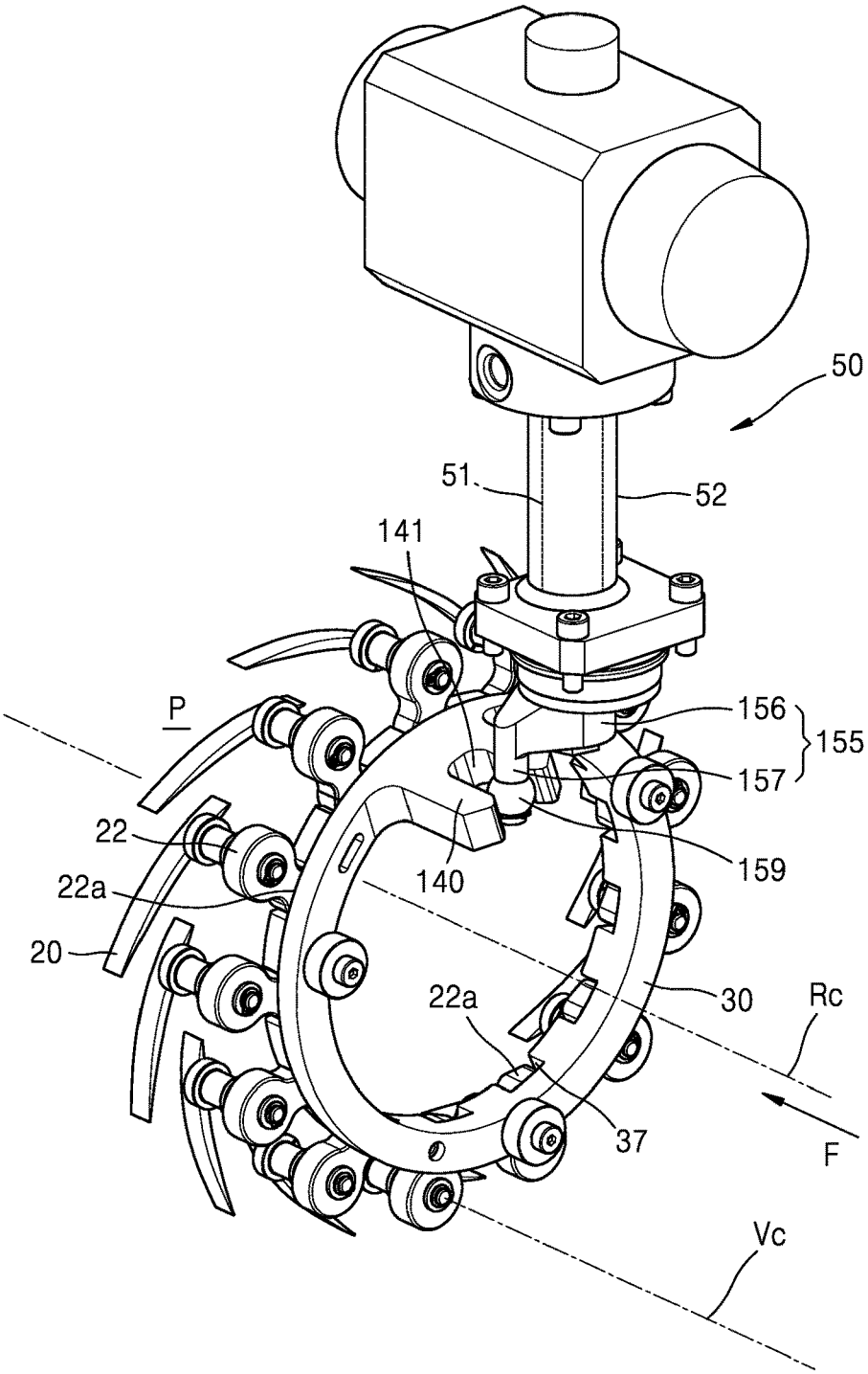
FIG. 7 is a perspective view schematically illustrating the connection relationship between some components of a fluid machine with variable vanes according to an exemplary embodiment.

FIG. 7 is a perspective view schematically illustrating the connection relationship between a transmission member 140 of a fluid machine with variable vanes and a driving assembly 50 including a connection member 155 according to an exemplary embodiment.

Because the components of the fluid machine according to the exemplary embodiment illustrated in FIG. 7 are similar to the components of the fluid machine according to the previous exemplary embodiment illustrated in FIGS. 1 to 6, the similar components will be denoted by the same reference numerals.

In the fluid machine of FIG. 7, the transmission member 140 and the connection member 155 of the driving assembly 50 are partially modified.

The connection member 155 of the driving assembly 50 includes an attachment member 156 that rotates together with the driving shaft 51, a pin 157 that is disposed at the end of the attachment member 156 and is disposed at a position deviating radially outward from the rotation center of the driving shaft 51, and an end roller 159 that is rotatably connected to the end of the pin 157.

The transmission member 140 protrudes outward from the transmission ring 30 and is an integral part of the transmission ring 30. The transmission member 140 includes a support hole 141 that extends in a direction that is parallel to the transmission ring rotation center Rc of the transmission ring 30 while crossing the rotation center of the driving shaft 51.

The end roller 159 of the connection member 155 is connected to the support hole 141 of the transmission member 140. The end roller 159 rotates on an outer surface of the pin 157 during the rotation of the driving shaft 51 and the attachment member 156. Because the force transmitted from the driving shaft 51 to the pin 157 is transmitted to the transmission member 140 through the support hole 141, the transmission ring 30 may be rotated by the rotation of the driving shaft 51.

Figure 8:
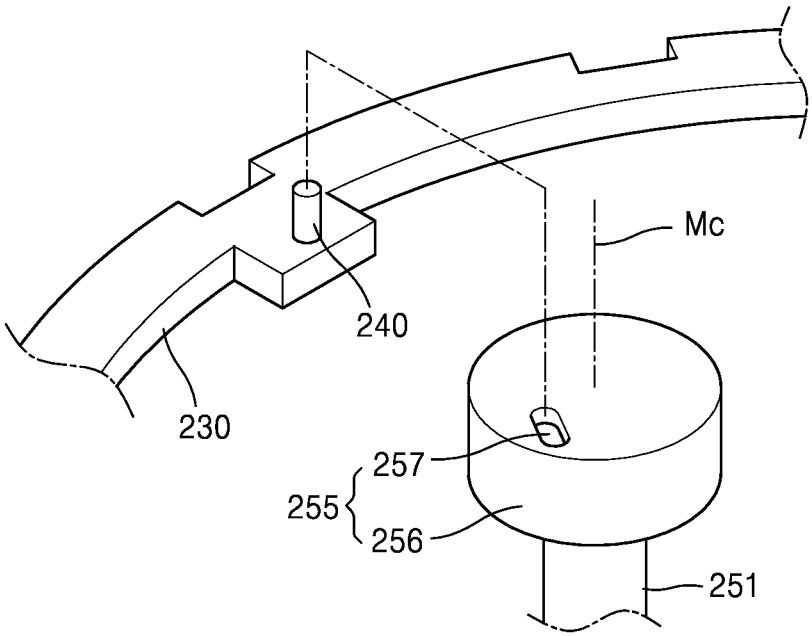
FIG. 8 is a perspective view schematically illustrating the connection relationship between some components of a fluid machine with variable vanes according to an exemplary embodiment.
Figure 9:
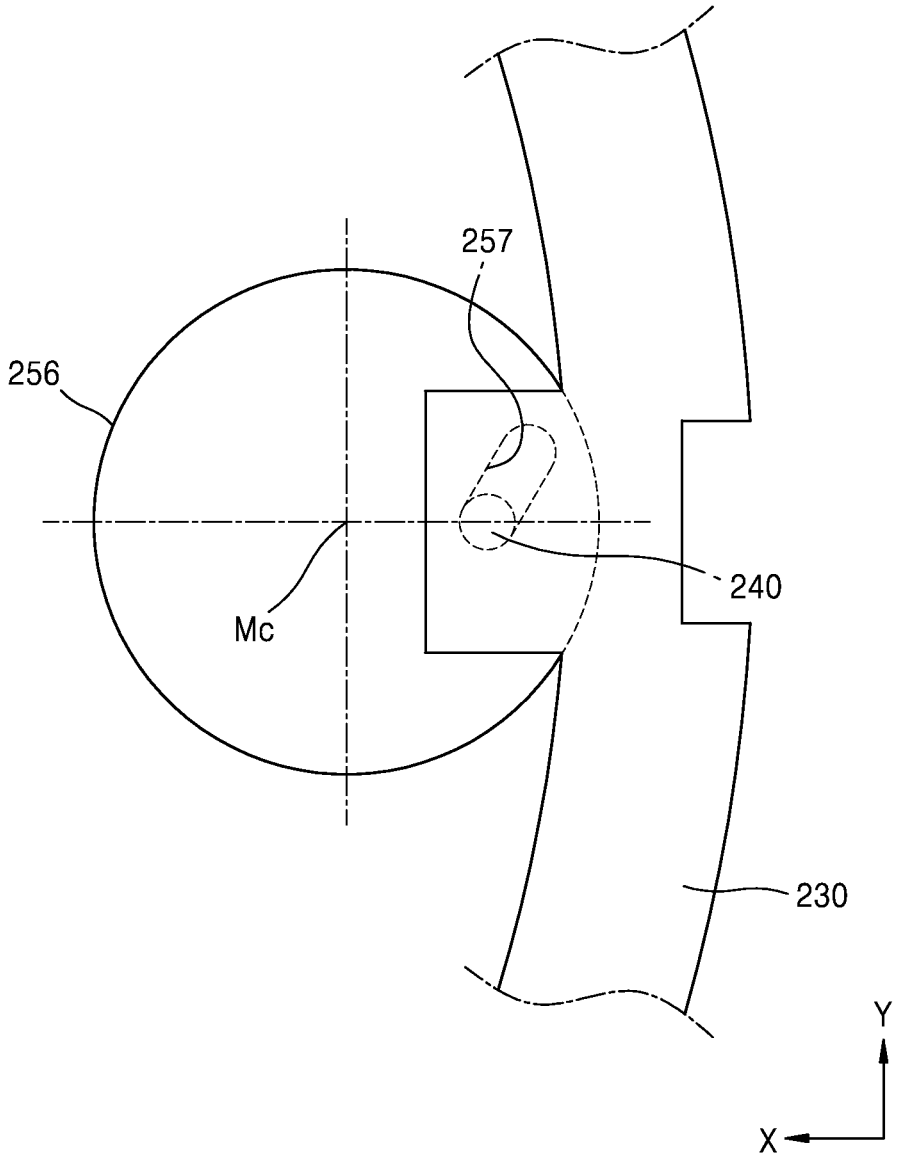
FIG. 9 is a cross-sectional view schematically illustrating the connection relationship between a connection member and a transmission member in the fluid machine of FIG. 8.

FIG. 8 is a perspective view schematically illustrating the connection relationship between a transmission member 240 of a fluid machine with variable vanes and a connection member 255 according to an exemplary embodiment. FIG. 9 is a cross-sectional view schematically illustrating the connection relationship between the connection member 255 and the transmission member 240 in the fluid machine of FIG. 8.

In the fluid machine according to the exemplary embodiment illustrated in FIG. 8, a transmission member 240 disposed on a transmission ring 230 includes a pin 240 that protrudes from the transmission ring 230 and has a circular cross-section. Also, a connection member 255 disposed at the end of a driving shaft 251 includes an attachment member 256 and a support hole 257 that is formed in the attachment member 256. The support hole 257 is located radially outward from the rotation center Mc of the driving shaft 251 and extends in a direction crossing an axis extending in a radial direction with respect to a rotation center Mc of the driving shaft 251.

The support hole 257 of the connection member 255 and the transmission member 240 of the transmission ring 230 are connected to each other at a position deviating radially outward from the rotation center Mc of the driving shaft 251. Thus, according to the rotation of the driving shaft 251, the force of the driving shaft 251 is transmitted to the transmission ring 230 through the support hole 257 and the transmission member 240 to rotate the transmission ring 230.

As described above, according to the above exemplary embodiments, in the fluid machine with variable vanes, the driving assembly may be easily disconnected/connected from/to the case. Thus, the components such as the seal rings of the driving assembly may be easily maintained without the need to disconnect the electric lines and the pipes connected to the fluid machine. Also, because the force of the driving assembly is directly transmitted to the transmission ring through a simple structure in which the connection member of the driving assembly is connected to the transmission member disposed on the transmission ring, the structure of the driving assembly of the fluid machine may be simplified and the size thereof may be minimized.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A fluid machine with variable vanes, the fluid machine comprising:

a case comprising a passage through which a fluid passes;

a plurality of vanes arranged along a circumferential direction of the passage of the case and configured to rotate to control an amount of the fluid passing through the passage;

a transmission ring rotatably provided in the case and configured to rotate with respect to the case, the plurality of vanes being attached to the transmission ring to rotate with the transmission ring;

a transmission member provided on transmission ring and configured to transmit an external rotation force to the transmission ring; and a driving assembly detachably attached to the case and comprising:

a driving shaft provided at an exterior of the case to rotate with respect to a first axis extending in a direction crossing a rotation axis of the transmission ring; and a connection member provided at a first end of the driving shaft, connected to the transmission member through a through hole of the case provided at a position corresponding to the transmission member and configured to rotate together with the driving shaft, wherein the connection member is disengageably engaged with the transmission member such that the driving assembly is disconnected from the case through the through hole, wherein the through hole of the case has a circular cross-section, and wherein the connection member comprises:

an attachment member having a circular cross-section corresponding to the through hole connected to the first end of the driving shaft: and a pin disposed at an end of the attachment member.

2. The fluid machine of claim 1, wherein the driving assembly further comprises a driving unit configured to rotate the driving shaft.

3. The fluid machine of claim 2, wherein the driving assembly further comprises:

a shaft support unit configured to rotatably support the driving shaft; and a seal ring provided between the shaft support unit and the driving shaft.

4. The fluid machine of claim 1, wherein the pin has a circular cross-section, and the transmission member comprises a support hole configured to movably support the pin.

5. The fluid machine of claim 4, wherein a portion of the support hole of the transmission member is opened.

6. The fluid machine of claim 4, wherein the support hole comprises a slot which extends in a direction that is parallel to the rotation axis of the transmission ring and crossing a rotation axis of the driving shaft.

7. The fluid machine of claim 4, wherein the driving assembly further comprises an end roller rotatably connected to an outer surface of the pin and configured to contact the support hole.

8. The fluid machine of claim 1, further comprising a fastening member configured to fasten the transmission member and the transmission ring.

9. The fluid machine of claim 1, wherein the transmission member is integrally formed with the transmission ring.

10. The fluid machine of claim 1, wherein the transmission member comprises a pin protruding toward the connection member and having a circular cross-section, and wherein the connection member comprises a support hole formed at the first end of the driving shaft to movably support the pin.

11. The fluid machine of claim 10, wherein the support hole extends in a direction crossing an axis extending in a radial direction with respect to a rotation center of the driving shaft.

12. The fluid machine of claim 1, further comprising a roller disposed along a circumferential direction of the transmission ring and being rotatable on the transmission ring to rotatably support the transmission ring on the case.

13. The fluid machine of claim 1, wherein the connection member is configured to engage or disengage with the transmission member in a direction parallel with the direction of a rotation axis of the driving shaft through the through hole.

14. The fluid machine of claim 1, wherein the connection member further comprises a pin disposed at the first end the driving shaft, and wherein the pin is offset in a radial direction from a rotation center of the driving shaft and is configured to engage with the transmission member.

15. The fluid machine of claim 1, wherein the transmission member is configured to protrude from the transmission ring along a direction substantially parallel with the rotation axis of the transmission ring.

16. The fluid machine of claim 15, wherein the transmission ring comprises:

a first surface on which the plurality of vanes are provided; and a second surface opposite to the first surface, and wherein the transmission member protrudes from the second surface of the transmission ring along the direction substantially parallel with the rotation axis of the transmission ring.

17. The fluid machine of claim 1, wherein the attachment member and the pin are configured to connect to the transmission member by being inserted through the through hole of the case.

* * * * *